United States Patent [19]

Sakamoto et al.

[11] 4,192,683

[45] Mar. 11, 1980

[54] PHOTOGRAPHIC LIGHT-SENSITIVE MATERIAL

[75] Inventors: Eiichi Sakamoto; Masao Ishihara; Kazuo Nakazato; Hiroshi Yamada; Sadatugu Terada; Kenichi Kitahara; Naoto Abe; Mamoru Komiya; Masaru Kanbe, all of Hino, Japan

[73] Assignee: Konishiroku Photo Industry Co., Ltd., Tokyo, Japan

[21] Appl. No.: 843,318

[22] Filed: Oct. 18, 1977

Related U.S. Application Data

[63] Continuation of Ser. No. 641,672, Dec. 17, 1975, abandoned.

[51] Int. Cl.[2] ..... G03C 1/76; G03C 1/02

[52] U.S. Cl. ..... 430/536; 430/636; 430/935

[58] Field of Search ..... 96/114.5, 114.7, 109, 96/67, 114

[56] References Cited

U.S. PATENT DOCUMENTS

| | | | |
|---|---|---|---|
| 2,719,087 | 9/1955 | Knox | 96/114.5 |
| 3,415,649 | 12/1968 | Nishio et al. | 96/114.7 |
| 3,525,620 | 8/1970 | Nishio et al. | 96/67 |
| 3,682,641 | 8/1972 | Casler et al. | 96/67 |
| 3,788,851 | 1/1974 | Willems et al. | 96/67 |
| 3,788,852 | 1/1974 | Sels et al. | 96/114.5 |
| 3,860,425 | 1/1975 | Ono et al. | 96/114.5 |
| 3,912,517 | 10/1975 | Van Poucke et al. | 96/114.5 |

FOREIGN PATENT DOCUMENTS

| | | | |
|---|---|---|---|
| 51-3219 | 10/1976 | Japan | 96/114.5 |

*Primary Examiner*—J. Travis Brown

*Attorney, Agent, or Firm*—Bierman & Bierman

[57] ABSTRACT

A photographic light-sensitive material comprising a layer which contains a compound represented by the following Formula I

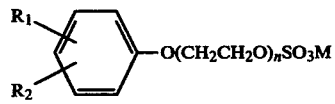

wherein $R_1$ is an alkyl group having 1 to 18 carbon atoms, $R_2$ is a hydrogen atom or an alkyl group having 1 to 18 carbon atoms with a proviso that when $R_2$ is a hydrogen atom, $R_1$ is an alkyl group having 1 to 7 carbon atoms, M is a cation and n is a number of 1 to 50.

3 Claims, No Drawings

PHOTOGRAPHIC LIGHT-SENSITIVE MATERIAL

This is a continuation application of Ser. No. 641,672, filed Dec. 17, 1975, now abandoned.

This invention relates to a photographic light-sensitive material. More particularly, the invention relates, a photographic light-sensitive material having multi-layer structure prepared by application of various photographic coating solutions, of which material layers are free from defects brought about in coating process.

As is well known in the art, photographic light-sensitive materials are prepared by forming such layers as an undercoating layer, a photosensitive layer, a protective layer, a filter layer and an anti-halation layer on a substrate such as a glass sheet, a baryta paper, a polyethylene-laminated paper and a plastic resin film of nitrocellulose, cellulose acetate, polyester or polycarbonate. Coating means such as a dipping method, a double-roll coating method and a slide hopper method are generally adopted for forming these coating layers on a substrate, and coated substrates are dried after the coating operation. At this coating step, it is important that each of these photographic coating solutions should be coated in a uniform thickness on the entire surface of the substrate.

As compared with the case where a coating solution is directly coated on the substrate, when a coating solution is applied to a dry coating of the previously applied coating solution or is applied to a coating layer which is previously formed and then cooled and set, or when a method in which plural layers are simultoneously formed is adopted, various defects are more readily formed on the surface of the coating because the surface state or condition is greatly different among materials to be coated thereon. Accordingly, in order to obtain a uniform coating, it is very important that a coating solution should uniformly spread on the surface or should uniformly wet the surface regardless of the surface condition.

In conventional processes, various defects are brought about at the coating steps; for example, so-called longitudinal or lateral uneveness, namely uneven coating formed in a direction rectangular or parallel to the coating direction, so-called comets, namely local incomplete coating caused by minute amounts of foreign materials present in the coating solution or on the surface to be coated, such as dusts, insoluble solids, coagulates and oleophilic substances, and thicker or thinner portions formed in the vicinity of edges of the coated surface by gathering or retreating of the coating solution.

Coating assistants represented by saponin have heretofore been used for preventing uneven coating by reducing the surface tensions of coating solutions.

Since saponin is a naturally occurring substance, its quality is not always constant. Accordingly, variations of the quality are inevitably observed among respective batches or lots. Further, even if the coating assistant of the uniform quality be employed, there is inevitably brought about a disadvantage that the photographic characteristics and the properties of the coating assistant greatly differ among respective batches.

Various synthetic surface active agents have recently been used as coating assistants instead of saponin including such defects. However, known surface active agents heretofore used in this field are insufficient in properties required of the coating assistant, especially durability under high temperature and high humidity conditions and adaptability to high speed coating. Moreover, most of these surface active agents are effective only for special photographic coating solutions or under specific coating conditions, and they lack versatility.

It is therefore a primary object of this invention to provide a photographic light-sensitive material prepared by coating various photographic coating solutions containing photographic binders represented by gelatin or coating solutions free of such binder, of which material layers are free from such defects brought about in coating process free of as unevenness, repellency, comets and local thickening and thinning.

Another object of this invention is to provide a coating assistant to be used especially suitably for the simultaneous multi-layer coating method employing various photographic coating solutions, which can provide a caoting solution excellent in the wetting, spreading and levelling characteristics.

Still another object of this invention is to provide a photographic light-sensitive material having excellent wettability to various photographic treating solutions, having stable photographic characteristics and being free from forming of bubbles on the surface of the photographic material even when it is subjected to the high-speed automatic development treatment.

We have found that the foregoing objects can be attained by incorporating into various photographic coating solutions a compound represented by the following general formula I as the coating assistant:

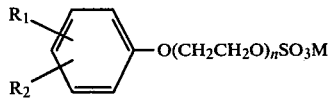

I wherein $R_1$ is an alkyl group having 1 to 18 carbon atoms, $R_2$ is a hydrogen atom or an alkyl group having 1 to 18 carbon atoms with a proviso that when $R_2$ is a hydrogen atom, $R_1$ is an alkyl group having 1 to 7 carbon atoms, M is a cation, and n is a number of 1 to 50.

A compound represented by the above general formula I, that is used in this invention has no bad influences on photographic emulsions.

Further, the compound of this invention is free of the quality variation such as observed in saponin, and even if it is used in a small amount, it can greatly reduce the surface tension of the coating solution after coating. Moreover, it has no viscosity-increasing property. Therefore, not only at an ordinary coating speed but also at such a high coating speed as 40 m/min or higher, it can provide a very uniform coating even when a coating solution in which the content of a binder such as gelatin is very low is employed. In short, the compound of this invention is characterized in that it can always impart stable coating properties to coating solutions.

In addition to such improved coating properties, the compound of this invention can impart a high antistatic property to photographic light-sensitive materials when it is incorporated into a protective layer, an undercoating layer, a super-coat layer or the like, and the compound of this invention has a merit that formation of static marks and the like can be effectively prevented by the use of the compound of this invention.

The compound of this invention is an alkyl-aryl polyether sulfate compound, and in the compound of this invention, a desirable surface activity suitable for attaining the objects of this invention can be obtained by a balance between the number of carbon atoms of the alkyl group introduced into the aryl group and the degree of polymerization in the polyether structure. Among compounds of this invention represented by the above general formula, those in which two alkyl groups are introduced into the aryl groups are especially excellent in the effect of improving the coating characteristics and provide most desirable results. Such compound is represented by the following general formula II

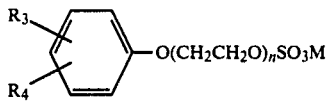

II in which $R_3$ and $R_4$ are respectively an alkyl group having carbon atoms of 1 to 18 and M and n are same as defined in the general formula I.

Branched alkyl groups give better results than linear alkyl groups as regards the wettability and therefore, they provide coating solutions which have improved coating characteristics and cause no bubbling and which produce photographic light-sensitive materials advantageous in that no bubbling is caused when they are contacted with photographic treating solutions. Accordingly, especially good results can be obtained by the use of compounds having two branched alkyl groups.

Typical instances of compounds represented by the above general formula will now be illustrated. It must be noted, however, that compounds to be included in the scope of this invention are not limited to those specifically illustrated below.

Instances of Compounds of This Invention (1)

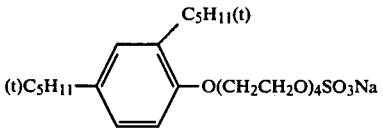

(2)

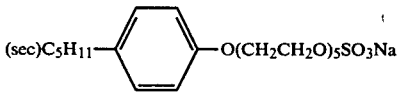

(3)

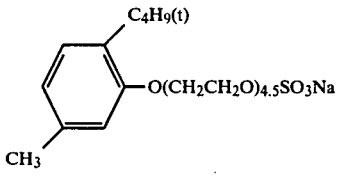

(4)

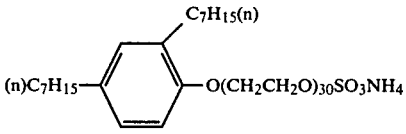

(5)

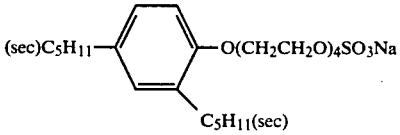

-continued (6)

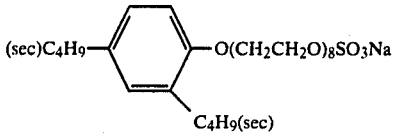

(7)

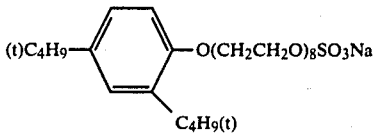

(8)

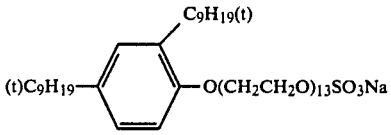

(9)

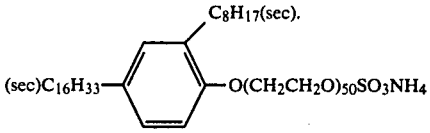

(10)

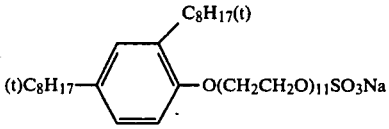

(11)

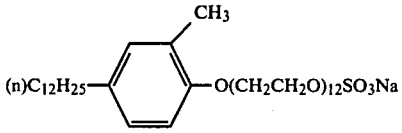

Synthesis of some typical instances of these illustrated compounds will now be illustrated by reference to the following Synthesis Examples.

SYNTHESIS EXAMPLE 1

[Synthesis of Compound (1)]

A 4-neck flask of a 200 ml-capacity was charged with 58.0 g (0.25 mole) of 2,4-di-tert-amylphenol and 0.4 g of potassium hydroxide was added thereto as a catalyst. Then, an agitator, a thermometer, a reflux device and a tube were attached to the flask. In an oil bath, ethylene oxide was added to the solution through the tube at an inside temperature of 135°±5° C. under agitation to effect reaction. The point of completion of the reaction was determined based on the increase of the weight of the reaction mixture (10 hours were required for 44 g increase of the weight). Then, 200 ml of benzene was added to the reaction mixture to form a solution. Then, the content of the flask was transfered into an egg-plant type flask, and 0.45 g of glacial acetic acid was added thereto to effect neutralization. Then, 200 ml of a saturated aqueous solution of sodium chloride was added to the mixture, and the mixture was refluxed under agitation for 1 hour in a boiling water bath. While the mixture was still hot, the liquid separation was carried out. The foregoing procedures of refluxing and liquid separation were further repeated two times. The benzene layer was collected and dehydrated with sodium sulfate, and the solvent was removed and recovered under reduced pressure, followed by drying under reduced pressure, to obtain 97.4 g (yield=93.3%) of an intermediate product. Then, 45.2 g (0.1 mole) of this intermediate was charged in a 100 ml-capacity 3-neck flask, and 40 ml of methylene chloride was added thereto to form a solution. A thermometer, a reflux device, and two tubes were attached to the flask, and the solution was agitated in an ice bath by a magnetic stirrer. Then, 12.9 g (0.11 mole) of chlorosulfonic acid was gradually added dropwise to the solution at an inside temperature of −6° to −1° C. After completion of the dropwise addition, the ice bath was taken away and reaction was caused to proceed at room temperature for about 1.5 hours. Then, nitrogen gas was introduced through one of the tubes and hydrochloric acid gas and methylene chloride were removed. The resulting paste was dissolved in 200 ml of a 2:1 mixture of water and methanol, and an aqueous solution of sodium carbonate was added to the solution to effect neutralization. Then, the mixture was concentrated on a water bath and dissolved in 95% ethanol to thereby remove inorganic substances. Then, water and ethanol were removed under reduced pressure to obtain 50.0 g (yield=91.2%) of the intended compound.

SYNTHESIS EXAMPLE 2

[Synthesis of Compound (2)]

The intended compound was prepared in the same manner as described in Example 1 except that the starting materials and reaction conditions were changed as indicated below:

Secondary amylphenol: 49.2 g (0.3 mole);
Ethylene oxide: 66.0 g (1.5 moles);
Potassium hydroxide: 0.3 g;
Adding time: 8 hours;
Yield of intermediate: 112.8 g (98.3%);
Intermediate: 57.6 g (0.15 mole);
Methylene chloride: 50 ml;
Chlorosulfonic acid: 19.4 g (0.16 mole);
Yield: 70.5 g (98.3%).

Addition of the compound of this invention prepared according to the method illustrated above to a photographic coating solution may be accomplished by dissolving the compound of this invention into water or a water-miscible organic solvent such as methanol, ethanol and acetone and mixing the solution into the coating solution. In the case of a photographic coating solution containing gelatin, the amount added of the compound of this invention is 0.01 to 10 g, preferably 0.02 to 5 g, per kg of the coating solution. No particular disadvantage is brought about when the compound of this invention is used in combination with other surface active agent. In general, addition of the compound of this invention is effected just before application of the coating solution. In case the compound of this invention is added to a photographic emulsion, the addition is generally effected after aging but just before coating, though the addition may be effected at an iptional stage during the aging step.

As the structural layer of a photographic light-sensitive material to which this invention is applied, there can be mentioned, for example, an intermediate layer, a protective layer, a filter layer, an undercoating layer, a anti-halation layer and a super-coat layer. Various silver halide emulsions such as emulsions for ordinary black-and-white photography, color photography, X-ray photography, printing, diffusion transfer photography and silver dye bleaching photography can be used as photographic emulsions for formation of these structural layers. These emulsions may be chemically sensitized by noble metals, sulfur, polyalkylene oxides and the like, or they may be optically sensitized. Further, various photographic additives such as stabilizers, film-hardening agents, wetting agents, water-dispersible particulate macro-molecular compounds, other film property-improving agents, development accelerators, hydrophilic or oleophilic color couplers, various dyes and dye carriers may be incorporated into these emulsions.

A photographic light-sensitive material excellent and uniform in quality is obtained in accordance with an embodiment of the present invention, in which an aqueous coating composition comprising an aqueous emulsion of a vinyl polymer and a compound represented by the general formula I or II is applied to a support to form a subbing layer on the support. The above-mentioned coating composition has low surface tension and the vinyl polymer is devided into fine particles in emulsion polymerization step. Accordingly, aggromeration of the vinyl polymer and formation of a surface film are prevented and thereby uneaveness of the coating such as local thickening and thinning are well prevented even when an aqueous coating composition low in vinyl polymer content is used.

The aqueous emulsion of vinyl polymer is that obtained by polymerizing monomers polymerizable through vinyl polymerization. The aqueous vinyl polymer emulsion is prepared by an usual emulsion polymerization in which a vinyl monomer of 5 to 50% by weight, an emulsifying agent, an anion surfactant such as a metal salt of an aliphatic alcoholicsulfate ester, for example, sodium laurylsulfate and a metal salt of an aromatic sulfonic acid, for example, sodium dodecylbenzensulfonate, and/or a nonion surfactant of 0.01 to 10% by weight are mixed; the mixture is stirred in a distilled water; a water-soluble reaction initiator such as potassium persulfate and ammonium persulfate of 0.001 to 0.01% by weight is added; and then polymerization was carried out under 50° C. The weight percentage mentioned above is that based on the solid content of the aqueous vinyl polymer emulsion.

The surfactant represented by the general formula I or II may replace a part or all of the above-mentioned emulsifying agent in the above preparation process.

As the vinyl monomer used in the preparation process, there can be mentioned ethylene, vinylchloride, vinylidenechloride, vinylacetate, vinylchloroacetate, styrene, substituted styrene, acrylonitrile, alkylacrylate ester such as methylacrylate and ethylacrylate, alkylmethacrylate ester such as methylmethacrylate, ethylmethacrylate and butylmethacrylate, alkylacrylate substituted with chlorine or phenyl, alkylmethacrylate substituted with chlorine or phenyl, vinylmethylether, vinylethylether, vinylchloroethylether, butadiene, isoprene, chlorprene, acrylamide, glycidylacrylate, glycidylmethacrylate, acrylic acid, methacrylic acid, itaconic acid, itaconic acid anhydride, itaconic acid monethyl ether, maleic acid, maleic acid anhydride, maleic acid monomethyl ester, fumaric acid, maleic acid amide, 2-hydroxymethyacrylate, hydroxybutylacrylate, di-(2-hydroxyethyl)maleyate, and N-(hydroxymethyl)acrylamide.

The aqueous polymer emulsion can be prepared by an usual polymerization process by using a monomer or monomers selected from, for examples, the above mentioned monomers.

As vinyl monomers to be used in a subbing composition for a photographic support using a polyester film, there can be mentioned vinylidene chloride, vinylchloroacetate, methylacrylate, ethylacrylate, methylmethacrylate, ethylmethacrylate, butadiene, acrylamide, glycidylacrylate, glycidylmethacrylate, acrylic acid, methacrylic acid, itaconic acid, malei acid anhydride and 2-hydroxymethacrylate.

Concrete examples of the vinyl polymers are shown below

II-1: Ethylacrylate/glycidylmethacrylate (25:75);
II-2: Ethylacrylate/hydroxyethylmethacrylate/itaconic acid (92:5:3);
II-3: Vinylidenechloride/methyacrylate/acrylic acid (60:35:5);
II-4: Vinylidenechloride/methyacrylate/itaconic acid (90:10:2);
II-5: Styrene/butadiene/itaconic acid (58:40:2);
II-6: α-chloromethylacrylate/methylacrylate/itaconic acid (70:25:5);
II-7: Ethylacrylate/styrene/acrylamide (50:20:30);
II-8: Butylacrylate/styrene/maleic acid anhydride/acrylamide (60:4:6:30).

In the above, polymerization ratio is of by weight.

This invention will now be illustrated in more detail by reference to the following Examples that by no means limit the scope of this invention.

EXAMPLE 1

A positive-type low-sensitivity silver chlorobromide (including 20 mole % of silver chloride) emulsion, containing 100 g of gelatin per mole of the silver halide, was divided into 7 portions. Compounds (2) and (4) in the form of aqueous solutions were added separately to 4 divided portions of the emulsion so that the compound content was 2 or 4 g per Kg of the emulsion.

Saponin as a comparative compound was added to two of the remaining three portions in amounts of 2 and 4 g per Kg of the emulsion, respectively. The remaining one portion of the emulsion was designated as a blank sample. These seven emulsions were coated on baryta coated papers at a coating speed of 40 m/min to prepare 7 photographic light-sensitive materials for positive prints.

Coating and photographic characteristics of these samples are shown in Table 1 given hereinafter. The sensitometry was performed by light-exposing samples with use of a sensitometer Model KSN (manufactured by Konishiroku Shashin Kogyo Kabushiki Kaisha) and subjecting them to the standard development treatment using a liquid developer D-72 (manufactured by Eastman Kodak Co.).

Table 1

| Compound Added | Amount Added (g/Kg of emulsion | Coating Characteristics: Number of Repellencies per 10 m² | Coating Characteristics: Number of Comets per 10 m² | Photographic Characteristics: Relative Sensitivity | Photographic Characteristics: Fog |
|---|---|---|---|---|---|
| Compound (8) | 2.0 | 0 | 0 | 100 | 0.04 |
| Compound (8) | 4.0 | 0 | 0 | 100 | 0.04 |
| Compound (4) | 2.0 | 0 | 2 | 101 | 0.04 |
| Compound (4) | 4.0 | 0 | 0 | 100 | 0.04 |
| Saponin | 2.0 | 5 | 4 | 100 | 0.04 |
| Saponin | 4.0 | 2 | 1 | 101 | 0.04 |
| Blank | — | 38 | 16 | 100 | 0.04 |

As is seen from the results shown in Table 1, emulsions according to this invention have very excellent coating characteristics and numbers of such defects as repellencies and comets can be greatly reduced when emulsions according to this invention are used. Further, it will readily be understood that the photographic properties are not adversely influenced by incorporation of compounds of this invention.

EXAMPLE 2

A high-sensitivity silver iodobromide (containing 2 mole % of silver iodide) emulsion for X-ray photography, containing 60 g of gelatin per mole of the silver halide, was divided into 6 portions. Compounds (1) and (3) were added separately to the divided portions of the emulsion in an amount of 2 g per Kg of the emulsion. The samples were coated on undercoated polyester films at a rate of 25 m/min, and then cooled and set. A 3% solution of gelatin, into which the examplified compounds (1) and (3) were incorporated respectively in an amount of 1 or 2 g per Kg of the solution, was coated as a protective layer on the above emulsion layer at the same coating rate as above. The following compound (comparative compound A) having a structure similar to that of the compound of this invention, which compound is disclosed in U.S. Pat. No. 3,026,202:

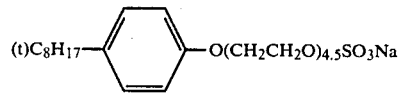

was similarly used for formation of an emulsion layer and a protective layer.

Each of the coated samples was dried and tested. Results of the tests made on coating characteristics are shown in Table 2 given hereinafter.

Table 2

| Compound Added | Amount Added to Emulsion Layer (g/Kg of emulsion) | Amount Added to Protective Layer (g/Kg of 3% gelatin solution) | Coating Characteristics: Number of Repellencies per 10 m² | Coating Characteristics: Number of Comets per 10 m² |
|---|---|---|---|---|
| Compound (1) | 2 | 1 | 0 | 0 |
| Compound (1) | 2 | 2 | 0 | 0 |
| Compound (3) | 2 | 1 | 0 | 1 |
| Compound (3) | 2 | 2 | 0 | 0 |

Table 2-continued

| Compound Added | Amount Added to Emulsion Layer (g/Kg of emulsion) | Amount Added to Protective Layer (g/Kg of 3% gelatin solution) | Coating Characteristics: Number of Repellencies per 10 m$^2$ | Coating Characteristics: Number of Comets per 10 m$^2$ |
|---|---|---|---|---|
| Comparative Compound A | 2 | 1 | 4 | 2 |
| Comparative Compound A | 2 | 2 | 1 | 1 |

As is seen from the results shown in Table 2, although in structural layers containing the comparative compound A coating defects are conspicuous especially when the amount added is samll, in structural layers containing compounds of this invention such defects as repellencies and comets are hardly caused even in the case of multi-layer coatings.

EXAMPLE 3

A silver iodobromide (containing 5 mole % of silver iodide) emulsion (containing 70 g of gelatin per mole of the silver halide), which had been secondarily aged according to a customary method, was mixed with saponin in an amount of 2 g per Kg of the emulsion. This emulsion and a 3% gelatin solution containing a compound of this invention indicated in Table 3 in an amount indicated in Table 3, as a protective layer-forming solution, were simultaneously coated according to the slide hopper method. Separately, the comparative compound A used in Example 2 was similarly incorporated into the protective layer-forming solution to obtain a comparative sample.

Each sample was coated, and the coating characteristics were examined and the contact angle to a liquid developer was determined to obtain results shown in Table 3 given hereinafter. At the measurement of the contact angle, the sample was placed horizontally and a liquid developer (D-72) was dropped on the surface of the sample. Determination of the contact angle was conducted by using a contact angle measuring device Elma (manufactured by Ikeda Rika Kabushiki Kaisha). A smaller contact angle indicates that a better wetting with the liquid developer and a better spreading of the liquid developer are attained at the step of developing the sample film and formation of bubbles on the film surface is lessened.

Table 3

| Compound Added | Amount Added to Protective Layer (g/Kg of 3% gelatin solution) | Coating Characteristics: Number of Repellencies per 10 m$^2$ | Coating Characteristics: Number of Comets per 10 m$^2$ | Contact Angle (°) |
|---|---|---|---|---|
| Compound (1) | 1 | 0 | 0 | 38 |
| Compound (1) | 2 | 0 | 0 | 33 |
| Compound (3) | 1 | 0 | 1 | 37 |
| Compound (3) | 2 | 0 | 0 | 32 |
| Comparative Compound A | 1 | 2 | 3 | 42 |
| Comparative Compound A | 2 | 0 | 1 | 37 |

As is seen from the results shown in Table 3, when compounds (1) and (3) of this invention are incorporated in a protective layer-forming solution, such coating defects as repellencies and comets are hardly caused even under simultaneous multi-layer coating conditions using a gelatin-containing colloidal solution. Further, the contact angle in samples containing the compound of this invention is much smaller than in samples containing the comparative compound A, and hence, according to this invention, there can be attained an advantage that occurrence of troubles at the developing step can be greatly reduced.

EXAMPLE 4

Saponin in an amount of 0.5 g per Kg of the emulsion was added as a coating aid to the same high-sensitivity silver iodobromide emulsion for X-ray photography as used in Example 2, and the emulsion was coated on an undercoated polyester film. Without drying or setting of the coated film, a 2.5% gelatin solution containing the compound 3 of this invention in an amount of 2 g per liter of the solution was coated as a protective layer on the so coated polyester film. The coated film was cooled and set to obtain a sample film. The state of the resulting coating was very good and the coating was excellent in uniformity.

The so obtained film was piled closely on an intensifying screen for X-ray photography (maximum wave length=425 nm) and at a relative humidity of 30%, a certain friction was given to the assembly from the side of the sensitizing paper by using a roller. Then, the film was separated and subjected to a customary development treatment, and the state of formation of static marks was examined. It was found that no static mark was formed.

A film was similarly prepared by using a protective layer-forming solution in which saponin was incorporated in an amount of 2 g per liter of the solution instead of the compound 3 of this invention. The film was treated in the same manner as described above. Conspicuous formation of static marks was observed.

EXAMPLE 5

Aqueous emulsions were prepared by respectively using the examplified compounds II-1 and II-3 as vinyl polymer and the examplified compound I-1 as emulsifying agent (2% by weight per the vinyl monomers), which emulsions contained solid content of 30% by weight.

Thus obtained emulsions were diluted with water to make the solid content 5% by weight, to obtain aqueous coating compositions (a) and (b) according to the present invention. The content of the examplified compound I-1 were 1 g per Kg of the aqueous coating composition.

On the otherhand, comparative coating compositions (c) and (d) were prepared by the same manner as the above except that sodium dodecylbenzen sulfonate (2% by weight per the vinyl monomers) was used as an emulfifying agent instead of the examplified compound I-1.

Also in this case, the content of the sodium dodecylbenzensulfonate was 1 g per Kg of the coating composition.

Aqueous coating compositions (e), (f), (g) and (h) were prepared the same manner as the preparation of the compositions (a) and (b) except that the amount of the examplified compound I-1 was changed to be to 10 g and to 60 g per Kg of the coating compositions.

The coating compositions (a), (b), (c), (d), (e), (f), (g) and (h) were respectively coated on polyethyleneterephthalate films having a thickness of 100μ at a coating speed of 20 m/min using a double roll coater so that the amount of coating was 20 g/m$^2$, and dried for 3 minutes at 100° C.

Thus obtained intermediates were coated with a gelatin solution having the composition given below so that the amount of a gelatin coating was 20 g/m$^2$ to obtain samples Nos 1 to 8.

| Gelatin Coating Composition | |
|---|---|
| Gelatin | 10 g |
| Saponin | 0.3 g |
| Water | 100 g |

Thus obtained samples were measured in smothness and eaveness of the coating according the following evaluation standards.

| Aggromeration of Vinyl Polymer | |
|---|---|
| Lesser than 5/m$^2$ | A |
| 6 to 30/m$^2$ | B |
| More than 31/m$^2$ | C |

The samples (a) to (h) were further coated with a X-ray silver halide emulsion containing silveriodobromide and the emulsion coated samples were measured in addhesiveness of the emulsion layer by the following tests.

(1) Dry Adhesiveness Test

The surface of dried samples was scratched by a razor in a checker pattern at the extent that the scratch reached to the support, an adhesive tape was sticked on the scrateched surface and then the sticked tape was abruptly peeled.

The sample in which pelled area of the silver halide emulsion layer was at most 5% was classified as A (the most favorable sample), the sample in which peeled area of the silver halide emulsion layer was 5 to 30% was classified as B and the sample in which peeled area of the silver halide emulsion layer was more than 30% was classified as C.

(2) Wet Adhesive Test

The surface of samples wetted with a developing solution was scratched by a needle in a checker pattern. The sample in which only scratched portion of the silver halide emulsion layer was removed was classified as A (the most favorable sample), the sample in which peeled area of the emulsion layer was at most 30% was classified as B and the sample in which peeled area of the emulsion layer was more than 30% was classified as C.

The result of the tests are shown in Table 4.

Table 4

| Sample No. | Compound I g/kg of Aqueous Coating Composition | Compound II | Aqueous Coating Compositon | Smoothness & Eeveness of Vinylpolymer Coating: Longitudinal Uneaveness | Lateral Uneaveness | Aggromeration |
|---|---|---|---|---|---|---|
| 1 | I-1 (1 g) | II-1 | a | A | A | A |
| 2 | I-1 (1 g) | II-3 | b | A | A | A |
| 3 | Sodium Dodecylbenzen Sulfonate (1 g) | II-1 | c | c | c | c |
| 4 | Sodium dodecylbenzen sulfonate (1 g) | II-3 | d | c | c | c |
| 5 | I-1 (10 g) | II-1 | e | A | A | A |
| 6 | I-1 (10 g) | II-3 | f | A | A | A |
| 7 | I-1 (60 g) | II-1 | g | A | A | A |
| 8 | I-1 (60 g) | II-3 | h | A | A | A |

| Lateral and Longitudinal Uneavenesses | |
|---|---|
| Found no uneaveness | A |
| Found weak uneaveness | B |
| Found strong uneaveness | C |

| Local Thinning and Thickening | |
|---|---|
| Found no thinning and thickening | A |
| Found weak thinning or thickening | B |
| Found strong thinning or thickening | C |

| Sample No. | Smoothness & Eeaveness of Gelatin Layer | Adhesiveness: Dry | Wet | Whole Eveluation |
|---|---|---|---|---|
| 1 | A | A | A | A |
| 2 | A | A | A | A |
| 3 | C | A | A | C |
| 4 | C | A | A | C |
| 5 | A | A | A | A |
| 6 | A | A | A | A |
| 7 | A | C | A | C |
| 8 | A | C | A | C |

EXAMPLE 6

The same samples as the sample 1, 2, 3 and 4 were coated with a solution having the composition given below at a coating speed of 50 g/m$^2$ to obtain diazonium light-sensitive materials.

| | |
|---|---|
| 2,5-Diethoxy-4-morpholynobenzene diazoniumtetrafluoroborate | 1.0 g |
| Hydrochloric acid salt of 3-hydroxy -2-naphthoic acid-ethanolamide | 1.5 g |
| Celluloseacetatebutylate | 5.0 g |
| Sulfosalicylic acid | 0.5 g |
| Citric acid | 0.5 g |
| Zinc chloride | 0.2 g |
| Ethylchloride | 60 ml |
| Ethyl alcohol | 30 ml |
| Dioxane | 10 ml |

Thus obtained samples was subjected to evaluation test for eaveness, thickening, thinning and dry adhesiveness according to the evaluation standard used in Example 5.

As the result of the test, samples according to the present invention, which samples were prepared by coating the samples 1 and 2 of Example 5 with the diazonium coating composition, exhibited excellency in coating eaveness and adhesiveness of the diazonium light-sensitive layer.

On the other hand, samples which were prepared by coating the samples 3 and 4 of Example 5 with the diazonium coating composition were excellent in the adhesiveness but bad in the eaveness and therefore were unacceptable to practical use.

What is claimed is:

1. A photographic light-sensitive material comprising a layer which contains a compound represented by the following Formula I

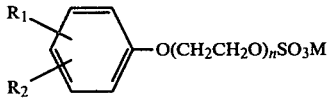

wherein $R_1$ and $R_2$ are individually a branched alkyl group having 1 to 18 carbon atoms; M is a cation; and n is a number of 1 to 50.

2. A photographic light-sensitive material comprising a support and a subbing layer formed by applying an aqueous emulsion, which comprises a particulate vinyl polymer and a compound as defined in claim 1, to said support.

3. A photographic light-sensitive material as defined in claim 1 wherein said compound is taken from the class consisting of:

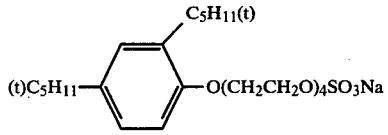

(1)

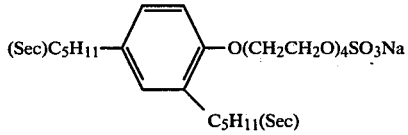

(2)

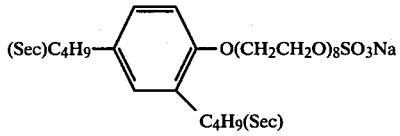

(3)

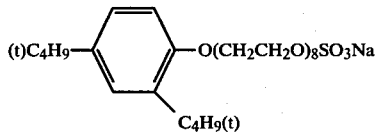

(4)

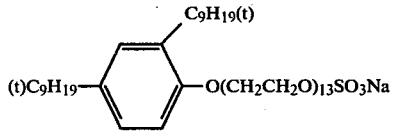

(5)

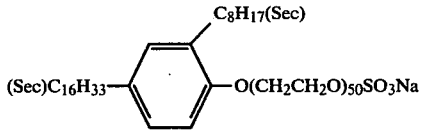

(6)

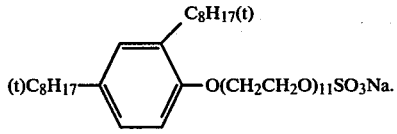

(7)

* * * * *